US006902135B2

(12) United States Patent
Boucher

(10) Patent No.: US 6,902,135 B2
(45) Date of Patent: Jun. 7, 2005

(54) DEVICE FOR GUIDING A WEB

(75) Inventor: Ronald Henry Boucher, Goffstown, NH (US)

(73) Assignee: Goss International Americas, Inc., Dover, NH (US)

( * ) Notice: Subject to any disclaimer, the term of this patent is extended or adjusted under 35 U.S.C. 154(b) by 85 days.

(21) Appl. No.: 10/320,273

(22) Filed: Dec. 16, 2002

(65) Prior Publication Data

US 2004/0113012 A1 Jun. 17, 2004

(51) Int. Cl.[7] ..... G03B 1/42; B65H 20/24

(52) U.S. Cl. ..... 242/615.21; 242/110; 242/118.2; 242/21

(58) Field of Search ..... 242/615.21; 226/110, 226/109, 118.2, 15, 21

(56) References Cited

U.S. PATENT DOCUMENTS

| | | | | |
|---|---|---|---|---|
| 4,863,087 A | | 9/1989 | Kohler | 226/197 |
| 5,108,022 A | | 4/1992 | Birkmair et al. | 226/197 |
| 5,121,910 A | * | 6/1992 | Hajek et al. | 270/10 |
| 6,450,382 B1 | * | 9/2002 | Ohno | 226/21 |
| 6,575,399 B1 | * | 6/2003 | Lamothe | 242/615.21 |

FOREIGN PATENT DOCUMENTS

| | | |
|---|---|---|
| DE | 296 14 681 | 11/1996 |
| EP | 0723862 | 7/1996 |
| EP | 0 849 203 | 6/1998 |

OTHER PUBLICATIONS

U.S. Ser. No. 09/887,291.

* cited by examiner

*Primary Examiner*—Evan Langdon
(74) *Attorney, Agent, or Firm*—Davidson, Davidson & Kappel, LLC

(57) ABSTRACT

A device for guiding a web includes a frame, a first angle bar angled with respect to the entering web direction and supported by the frame for movement along a first path, the first angle bar having a first and a second side, a second angle bar angled with respect to the entering web direction and supported by the frame for movement along a second path, and a roller for changing a direction of the web between the first angle bar and second angle bar, the roller being moveable along a third path so as to be movable laterally beyond both the first side and second side of the angle bar.

20 Claims, 14 Drawing Sheets

DEVICE FOR GUIDING A WEB

BACKGROUND INFORMATION

The present invention relates generally to web printing presses and more particularly to a device for guiding a printed web.

U.S. Pat. No. 5,108,022 discloses a universal web turning system, particularly for printed webs derived from a rotary web-type printing machine. The turning system has a first turning bar and a second turning bar and a first and a second deflection roller which are retained in an essentially rectangular frame. The position of the turning bars is adjustable along the sides of the frame. The deflection rollers may be supported in bearing blocks which can be shifted longitudinally and well as vertically. The first deflection roller is located laterally of a first side of the turning bars, and the second deflection roller is located laterally of a second side of the turning bars, as the bearing blocks for the deflection rollers are located in the same tracks as the turning bars and thus cannot cross over the turning bars U.S. Pat. No. 4,863,087 discloses a running web adjustable guide apparatus in which lateral adjustment of the web can be accomplished without changing the length of the path of the web through the apparatus. A movable roller 21 is linked in movement with a guide bar 14 and runs on the same guide rails as the guide bar.

BRIEF SUMMARY OF THE INVENTION

U.S. Ser. No. 09/887,291, issued as U.S. Pat. No. 6,705,220, discloses a web guiding device with two movable angle bars, and is hereby incorporated by reference herein.

An object of the present invention is to provide movable rollers in combination with angle bars that permit a wider variety of configurations.

The present invention provides a device for guiding a web having an entering web direction comprising a frame; a first angle bar angled with respect to the entering web direction and supported by the frame for movement along a first track, the first angle bar having a first side and a second side; a second angle bar angled with respect to the entering web direction and supported by the frame for movement along a second track; and a roller for changing a direction of the web, the roller being movable along a third track so as to be movable laterally beyond both the first side and second side of the first angle bar.

By providing the at least one roller on an independent track which permits the roller to cross over the first angle bar in the lateral direction, the roller can be configured to reduce web length in the device and to provide more access space. The roller can also perform additional functions.

The first and second angle bars in one web orientation are parallel to each other, and for another web orientation may be moved to be at a 90 degree angle to each other.

Preferably, a second roller movable along the third track is included, and is capable of moving to either side of the first angle bar.

Each of the first and second rollers may move laterally beyond the frame in one direction, which can provide for a so-called bay window function to provide better web movement between additional angle bars.

Preferably, the first, second and third tracks are all horizontal, and the third track is located vertically between the first and second tracks.

At least a third and a fourth angle bar and third and fourth roller, configured similarly to the first and second angle bars and roller and second roller, may be provided at a different vertical level and operate independently from the first and second angle bar with the first two rollers. Additional angle bar pairs may be provided at other vertical levels.

Preferably, the device has at least two lateral entering and exiting positions for the web, and each angle bar has at least two lateral operating positions and two parking positions on either side of the device. The movable rollers preferably have at least four lateral operating positions. The rollers and angle bars advantageously need not move vertically. More lateral positions however may be provided and the angle bars may be positioned at any location along the lateral extent of the frame.

The movable rollers also may be controlled to maintain proper registration, for example print-to-cut registration in a folder, by compensating for changes in web length in the device.

A number of operating positions thus may be obtained. Using the two angle bars parallel to each other and both rollers, the web can enter right side up in any of the three lateral position and exit laterally in any of the three lateral positions with the web in the same orientation, i.e. with the web exiting right side up. One roller preferably stays just to the left of the first angle bar, and the other roller just to the right of the second angle bar, so as to reduce overall web travel through the device.

To reverse orientation, the web can travel over the first angle bar, reverse direction at the roller and then travel directly over the second angle bar. The second angle bar is at 90 degree angle to the first angle bar, and thus the web exits up side down from the entering direction. The second roller may remain in a parked position.

To permit bay window operation, which allow the web to move vertically to the side of the device without interfering with components, the third and fourth angle bars are located below the first and second angle bars.

To move the web upwardly using a bay window and maintain orientation, the web can enter at a lower third angle bar right side up, move via the third roller at a position laterally beyond the frame, move vertically upward to the first roller directly above the third roller, pass over the second roller and exit right side up over the second angle bar, the second angle bar being parallel to the third angle bar. If the bay is to be on the other side, the third and fourth rollers can be used, with the second roller being located directly over the fourth roller and the web passing directly from the second roller to the second angle bar.

To move the web upwardly and reverse web orientation, the third and second angle bars are placed at 90 degree angles to each other. If the bay is on one side, all four rollers are used, and if on the other, only two rollers need be used.

To move the web downwardly with a bay window and maintain web orientation, the first and fourth angle bars are parallel, and for one side the web passes over the first angle bar between the first and second roller and then down to the third roller. The web then passes horizontally to the fourth roller and then over the fourth angle bar to exit right side up. If the bay is on the other side, the web passes from the first angle bar to the first roller and then over to the second roller in a bay position. The web then passes to the fourth roller in its bay position and over the third roller to the fourth angle bar.

To move the web downwardly with a bay window and reverse web orientation, the first and fourth angle bars are at 90 degree angles. If the bay is on one side, the first and third rollers are in their bay position, and the second and fourth rollers next to their respective angle bars. If the bay is on the other side, the second and fourth rollers are in their bay positions and the first and third rollers next to the second and fourth rollers, respectively.

BRIEF DESCRIPTION OF THE DRAWING

The device according to the present invention is explained in greater detail below with reference to the drawings showing an embodiment with four angle bars and four rollers, in which.

DETAILED DESCRIPTION

Figure 1:
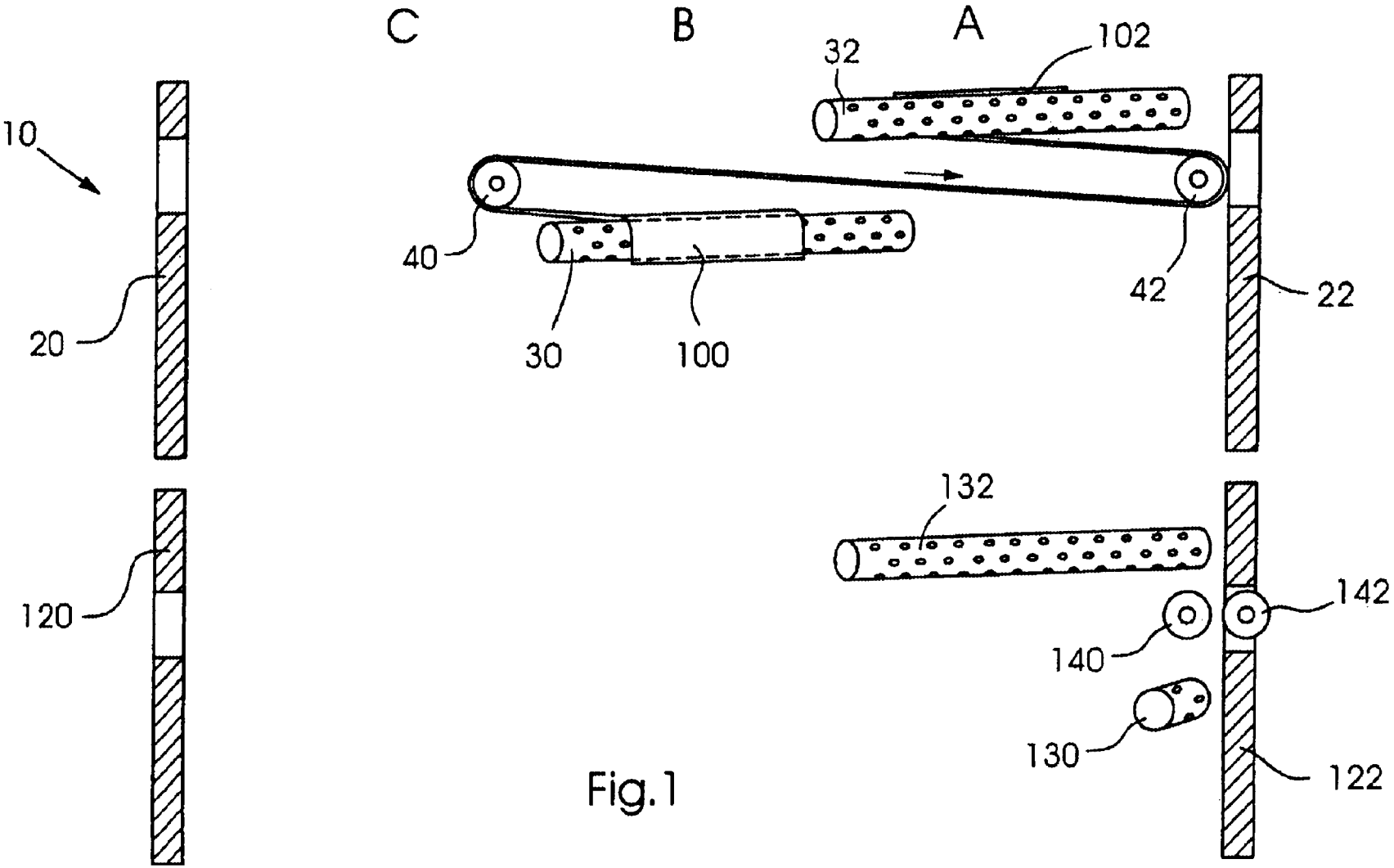
FIG. 1 shows the device according to the present invention viewed from the folder toward a printing press, with the web entering at lateral location B and exiting in a same orientation at location A.
Figure 13:
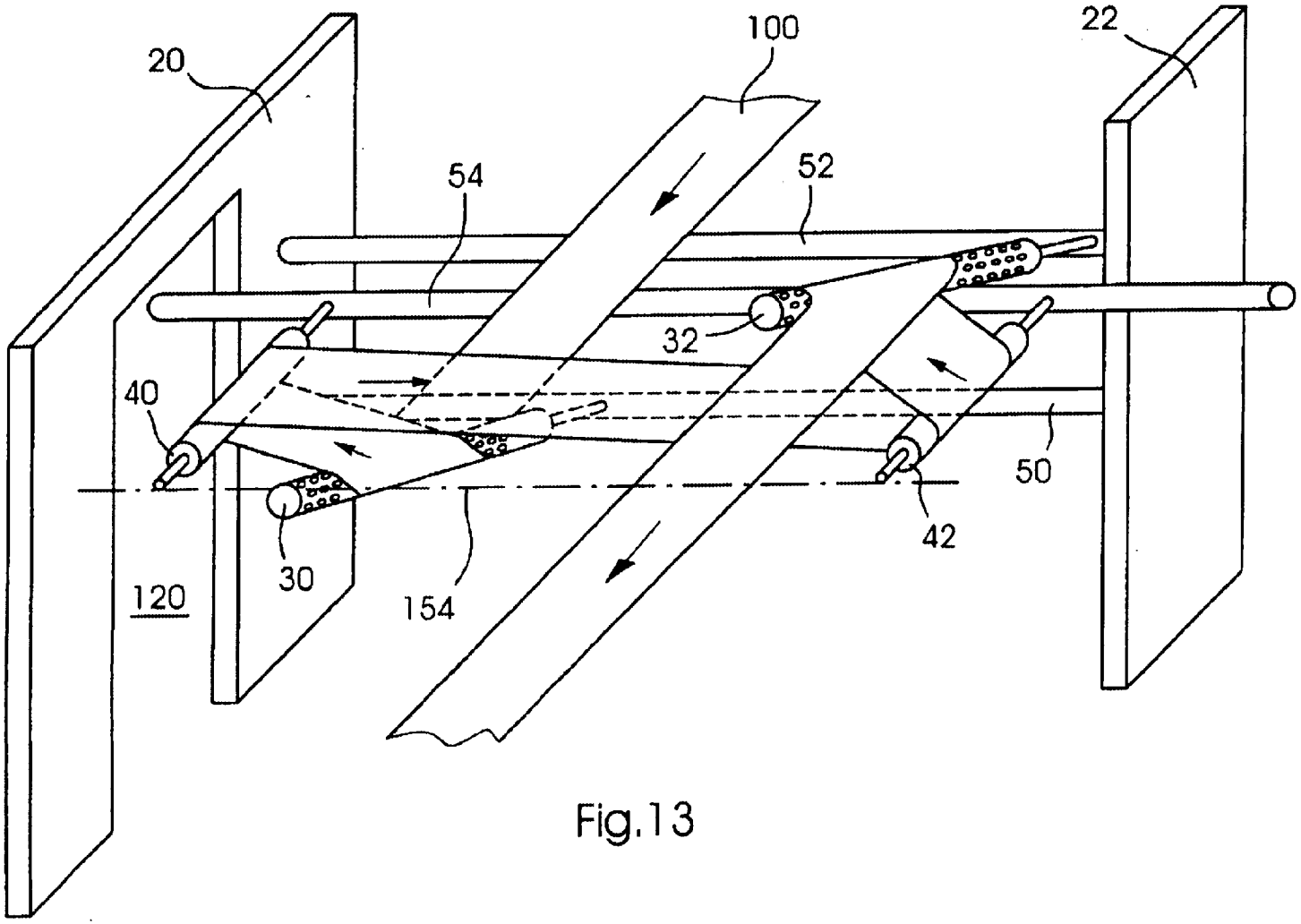
FIG. 13 shows a schematic perspective view of the top half of the device according to the present invention shown in FIGS. 1 to 12.

FIG. 1 shows an embodiment of the device according to the present invention viewed from the folder toward a printing press, with the web entering at lateral location B and exiting in a same orientation at location A. FIG. 13 shows a perspective view of the top half 10 of the device of FIG. 1. In certain operative modes, for example in FIGS. 1 to 4, only the top half 10 of the device is used.

The web guiding device in FIGS. 1 and 13 includes a first angle bar 30 at a forty five degree angle to the entering web 100 (entering from the printing press, i.e. the web is moving toward the viewer of FIG. 1), which turns the web 90 degrees toward a first movable roller 40. The web then turns 180 degrees toward a second movable roller 42, then around another second angle bar 32 parallel to first angle bar 30. Web then exits (toward the folder, i.e., toward the viewer of FIG. 1) at an exit position 102.

The web 100 thus maintains its right side up orientation and enters at a lateral location B and exits at a lateral location A. Lateral location C, because first roller 40 is close to first angle bar 30, remains clear, which can be advantageous for maintanence or other operations. A lower section with frame parts 120, 122, a third angle bar 130, fourth angle bar 132, third roller 140 and fourth roller 142 remains inactive during the FIG. 1 mode, although it should be understood that this lower section could operate simulatenously with a different web as web 100 is guided through top half 10.

A frame for the upper section 10 may include frame sections 20, 22. As shown schematically in FIG. 13, frame section 20 may have an aperture 120 at the side to permit roller 40 to pass laterally beyond frame section 20. Frame section 22 may be likewise constructed to permit roller 42 to pass laterally through an aperture.

Frame sections 20, 22 support a first track 50, a second track 52 and a third track 54, which may be located vertically between the first and second tracks. Angle bar 30 can move in laterally in track 50, and is supported at a front end in FIG. 13 in another track, so that bar 30 is supported at both ends and can maintain the angle shown in FIG. 13 or be reversed 90 degrees so as to be 90 degrees with respect to second angle bar 32. Angle bar 32 likewise runs in track 52, and likewise can reverse 90 degrees. Rollers 40, 42 are supported commonly in track 54 on one end, and by another track 154, represented by a dashed line, on a front end. The rollers 40, 42 and angle bars are automatically movable, for example by linear motors running in the tracks.

Rollers 40, 42 have a full range of lateral motion between the frames, as do the angle bars 30, 32. Rollers 40, 42 can also pass beyond the frame secitons 20, 22, respectively to provide a bay window function. The lower section of the device is contructed similarly, so that angle bars 130, 132 and rollers 140 and 142 also have a full range of lateral motion.

Figure 14:
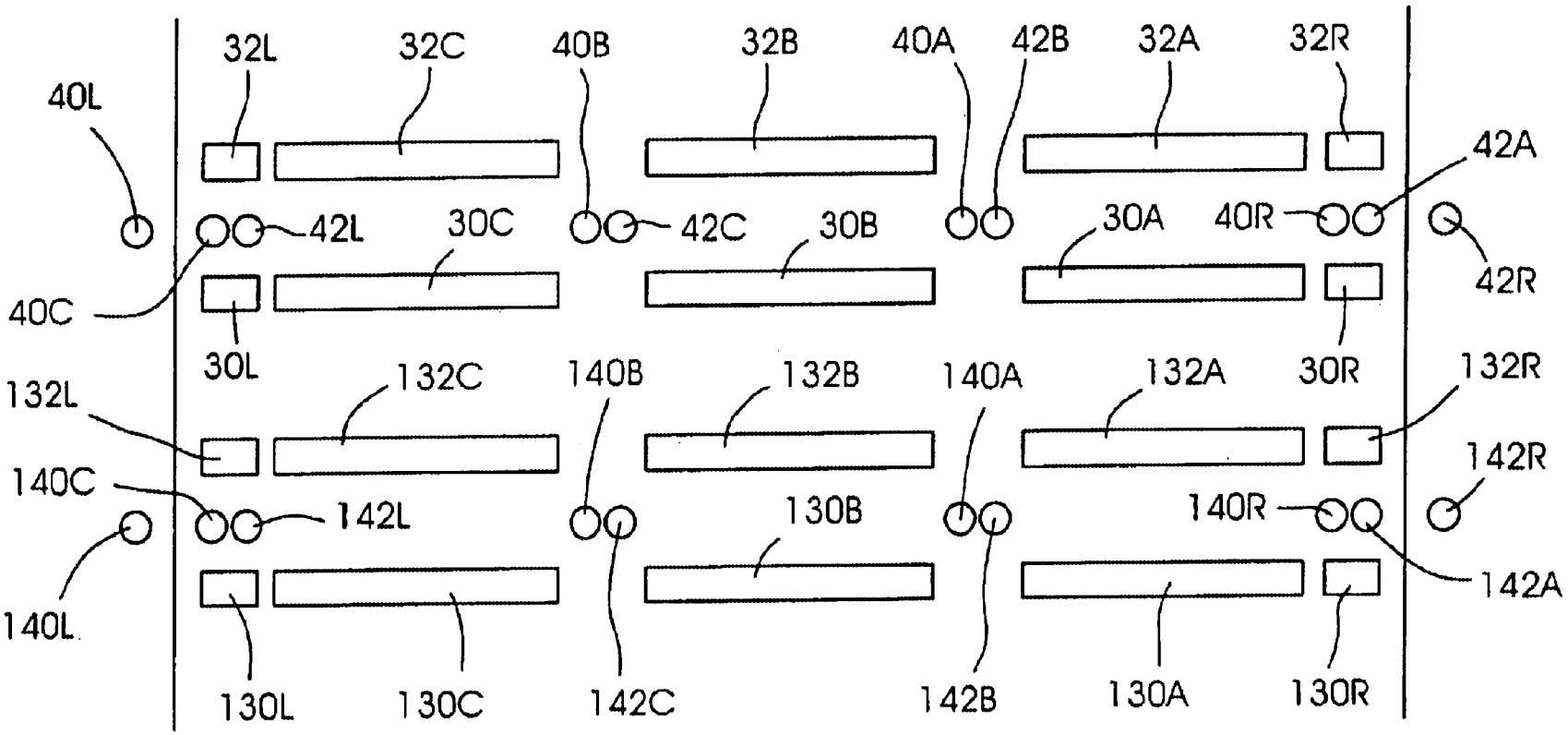
FIG. 14 shows the various possible locations of the embodiment of FIG. 1.

FIG. 14 shows schematically a range of positions for the embodiment of FIG. 1. For example, angle bars 30, 32, 130 and 132 of FIG. 1 can have any of five lateral locations, including first operating lateral locations 30A, 32A, 130A, 132A, respectively, second operating lateral locations 30B, 32B, 130B, 132B, respectively, and third operating lateral locations 30C, 32C, 130C, 132C, respectively. Two parking positions 30L and 30R, 32L and 32R, 130L and 130R, and 132L and 132R, respectively for each angle bar, are provided as well. However, it should be undertood that any number of two or more lateral positions are possible and intermediate positions to those shown in FIG. 14 are possible as well.

Roller 40 may have, for example, five operating positions 40A, 40B, 40C, 40L, and 40R. Roller 42 then also may have five operating positions 42A, 42B, 42C, 42L, and 42R. Roller 140 may have five operating positions 140A, 140B, 140C, 140L, and 140R. Roller 142 may have five operating positions 142A, 142B, 142C, 142L, and 142R. It should be understood that any number of two or more positions are possible, and intermediate positions to those shows in FIG. 14 are possible as well.

Figure 2:
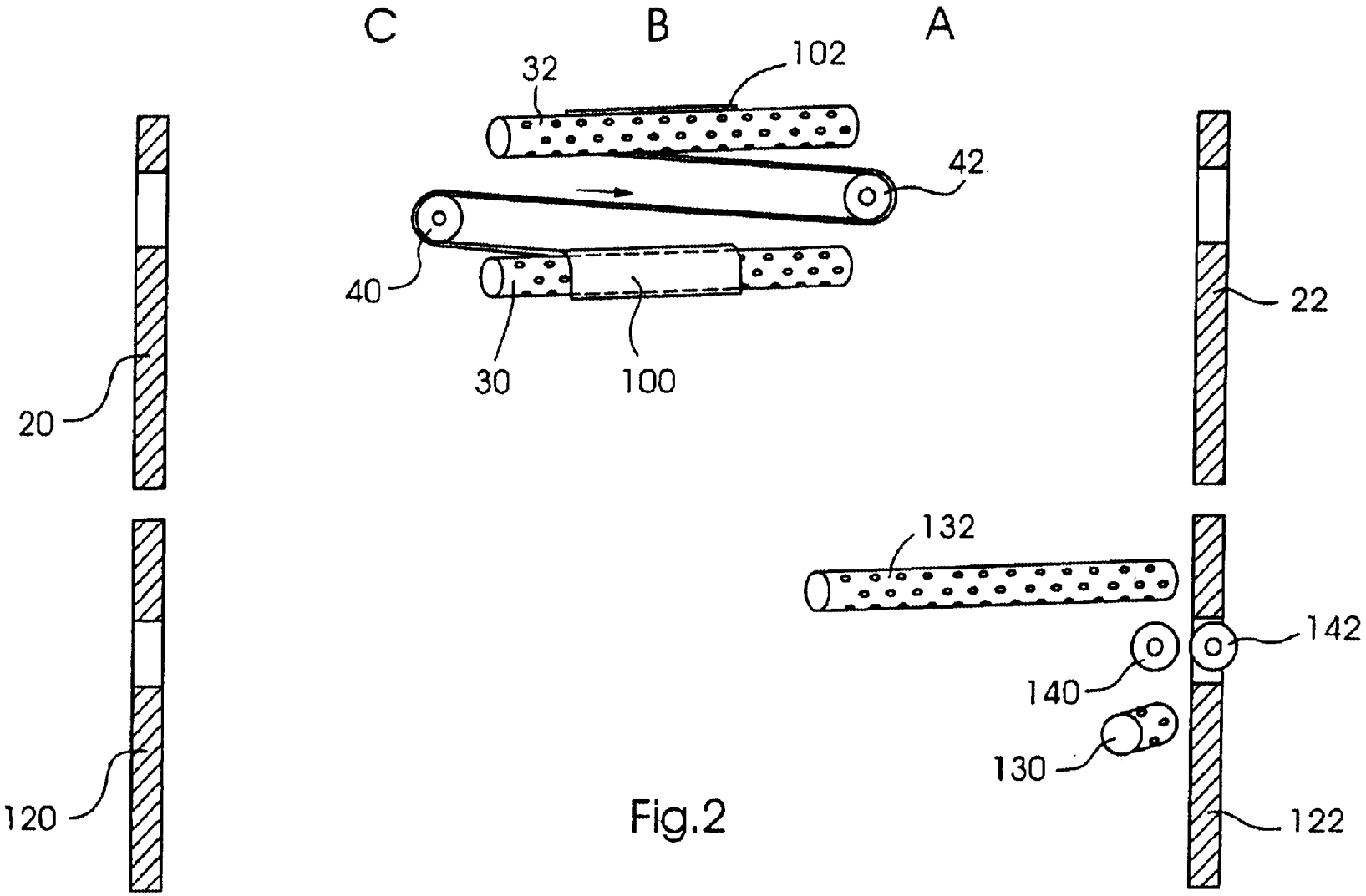
FIG. 2 shows the device according to the present invention with the web entering at lateral location B and exiting in a same orientation at location B.

FIG. 2 shows the device according to the present invention with the web 100 entering at angle bar 30 at lateral location B, passing over rollers 40, 42, and exiting at position 102 in a same orientation at location B over angle bar 32.

Figure 3:
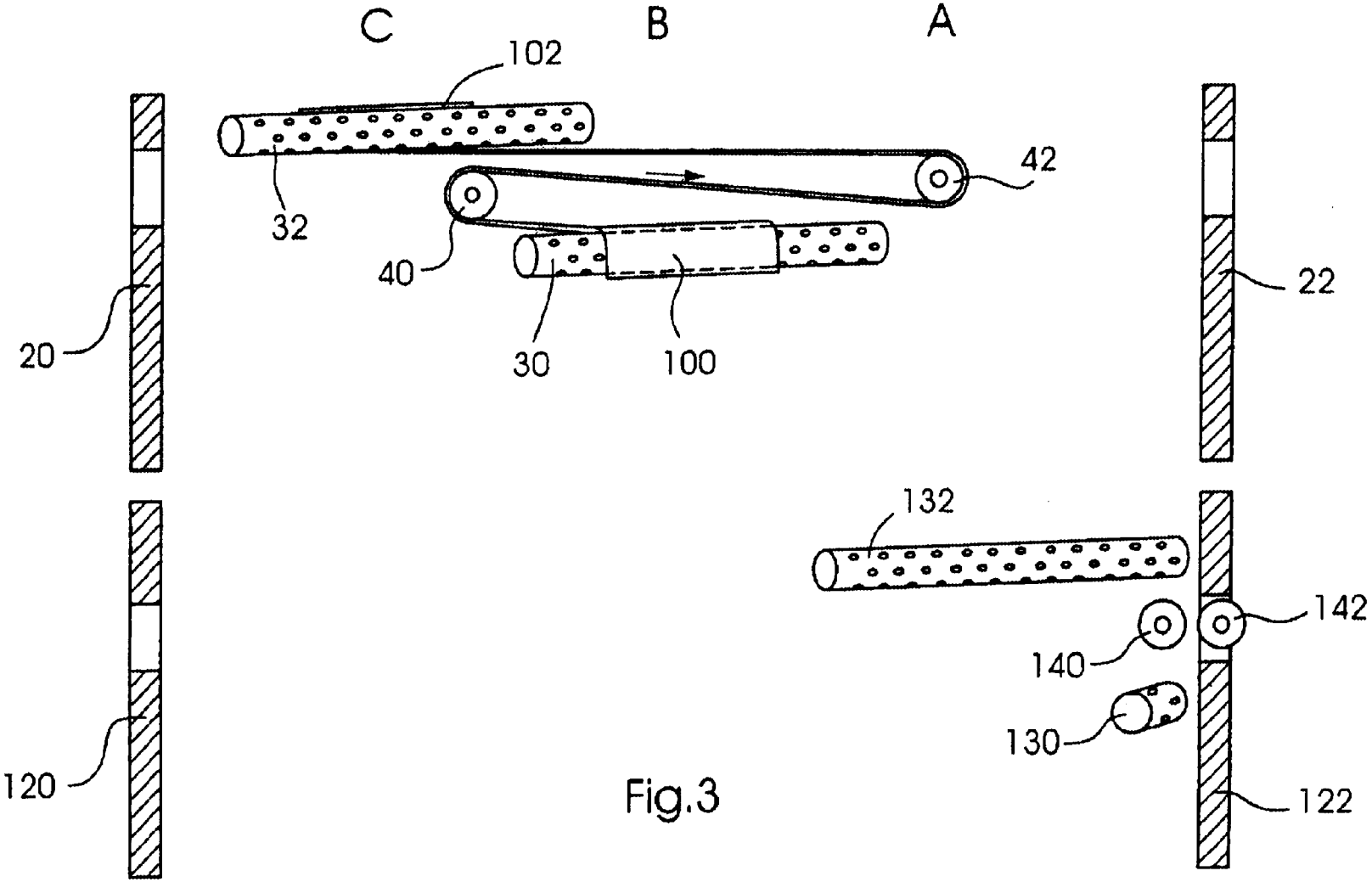
FIG. 3 shows the device according to the present invention with the web entering at lateral location B and exiting in a same orientation at location C.

FIG. 3 shows the device according to the present invention with the web entering at angle bar 30 at lateral location B, passing over rollers 40, 42 and exiting at position 102 in a same orientation at location C over angle bar 32.

Similar to the FIGS. 1 to 3 positions in which the web enetrs and exits in the same right side up orientation, web 100 also could enter at lateral location A or C, and exit at any lateral location, as long as roller 40 stays to the left of angle bar 30, and roller 42 to the right of angle bar 32.

Figure 4:
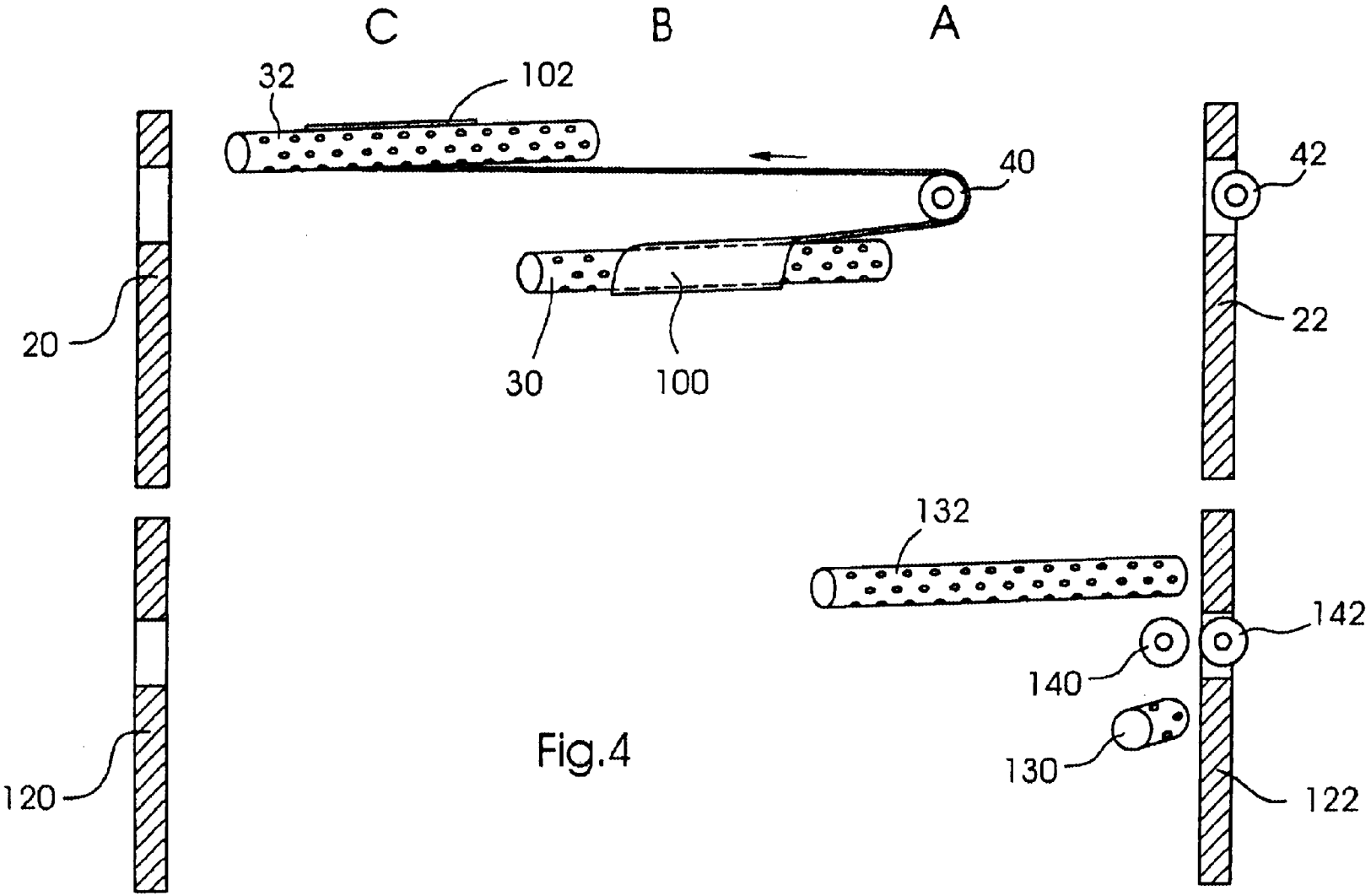
FIG. 4 shows the device according to the present invention with the web entering at lateral location B and exiting in a reverse orientation at location C.

FIG. 4 shows the device according to the present invention with web 100 entering over angle bar 30, now in a 90 degree reversed orientation, at lateral location B. Web 100 then passes over roller 40, reverses direction and exits over angle bar 32 at position 102 in a reverse orientation upside down from the entering orientation at location C. Rollers 42, 140, 142 and angle bars 130 and 132 remain in a parked position.

Figure 5:
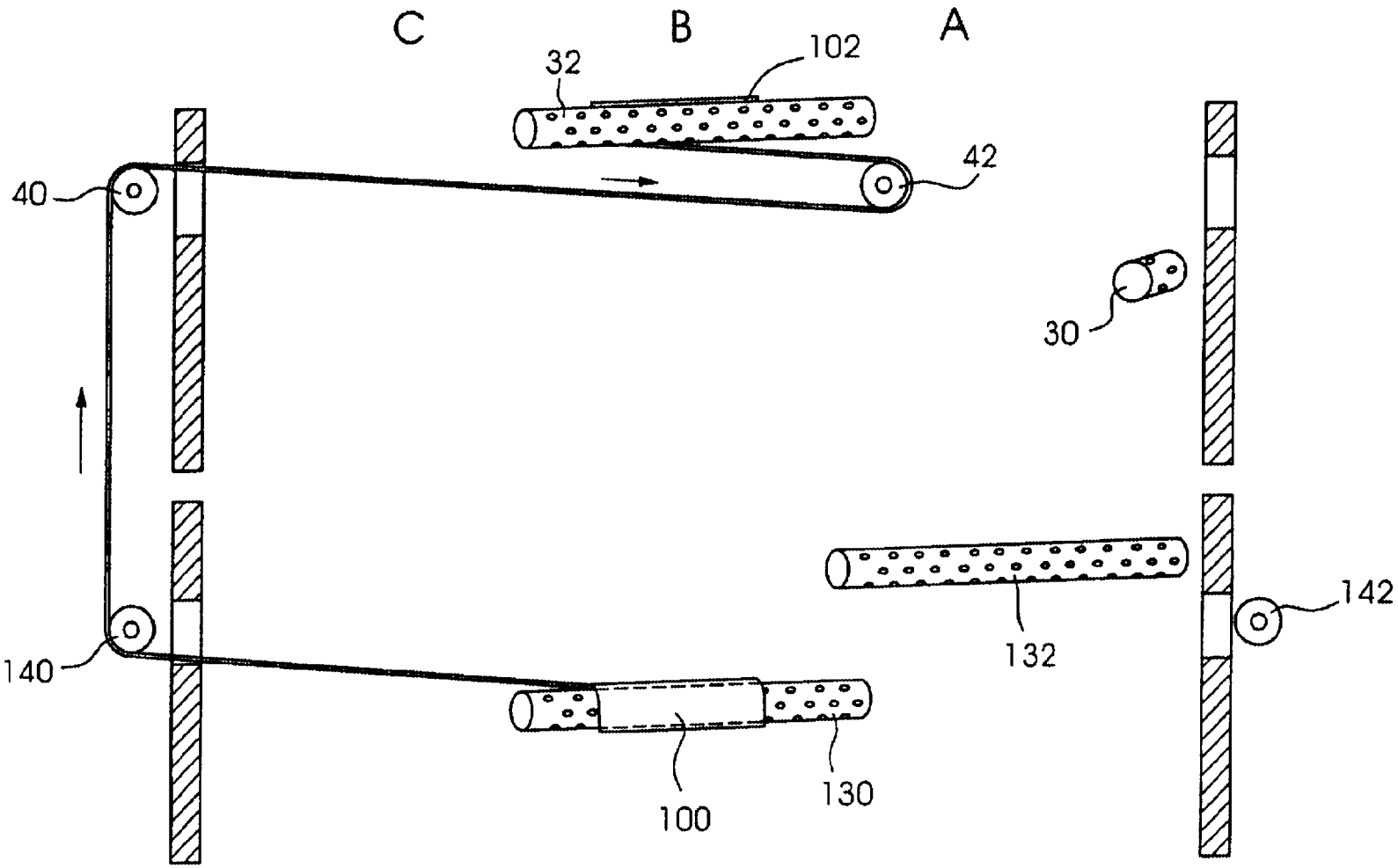
FIG. 5 shows the device according to the present invention with the web entering at lateral location B, passing up a left bay window, and exiting in a same orientation at location B.

FIG. 5 shows the device according to the present invention with web 100 entering at lateral location B over third angle bar 130, passing over rollers 140 and 40 in their left bay window position, and passing over roller 42. Web 100 then passes over second angle bar 32 and exits at position 102 in a same up side right orientation at location B. Angle bar 130 may operate from any lateral position A,B,C as can angle bar 32.

Figure 6:
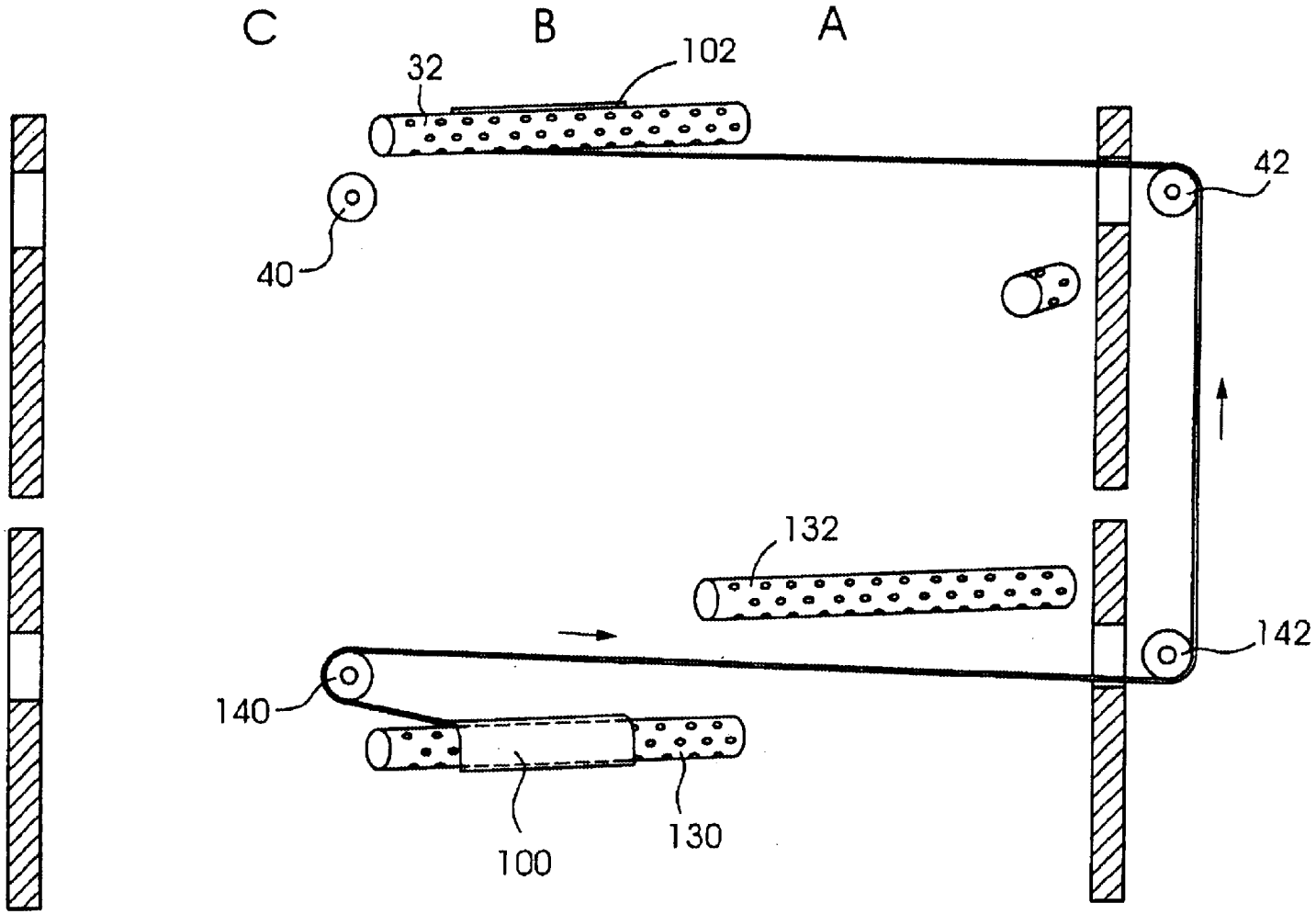
FIG. 6 shows the device according to the present invention with the web entering at lateral location B, passing up a right bay window, and exiting in a same orientation at location B.

FIG. 6 shows web 100 entering at lateral location B over angle bar 130, passing up a right bay window, and exiting in a same orientation over angle bar 32 at location B. In this configuration, rollers 42 and 142 are located in their right bay positions, and roller 140 is located to the left of angle bar 130.

Figure 7:
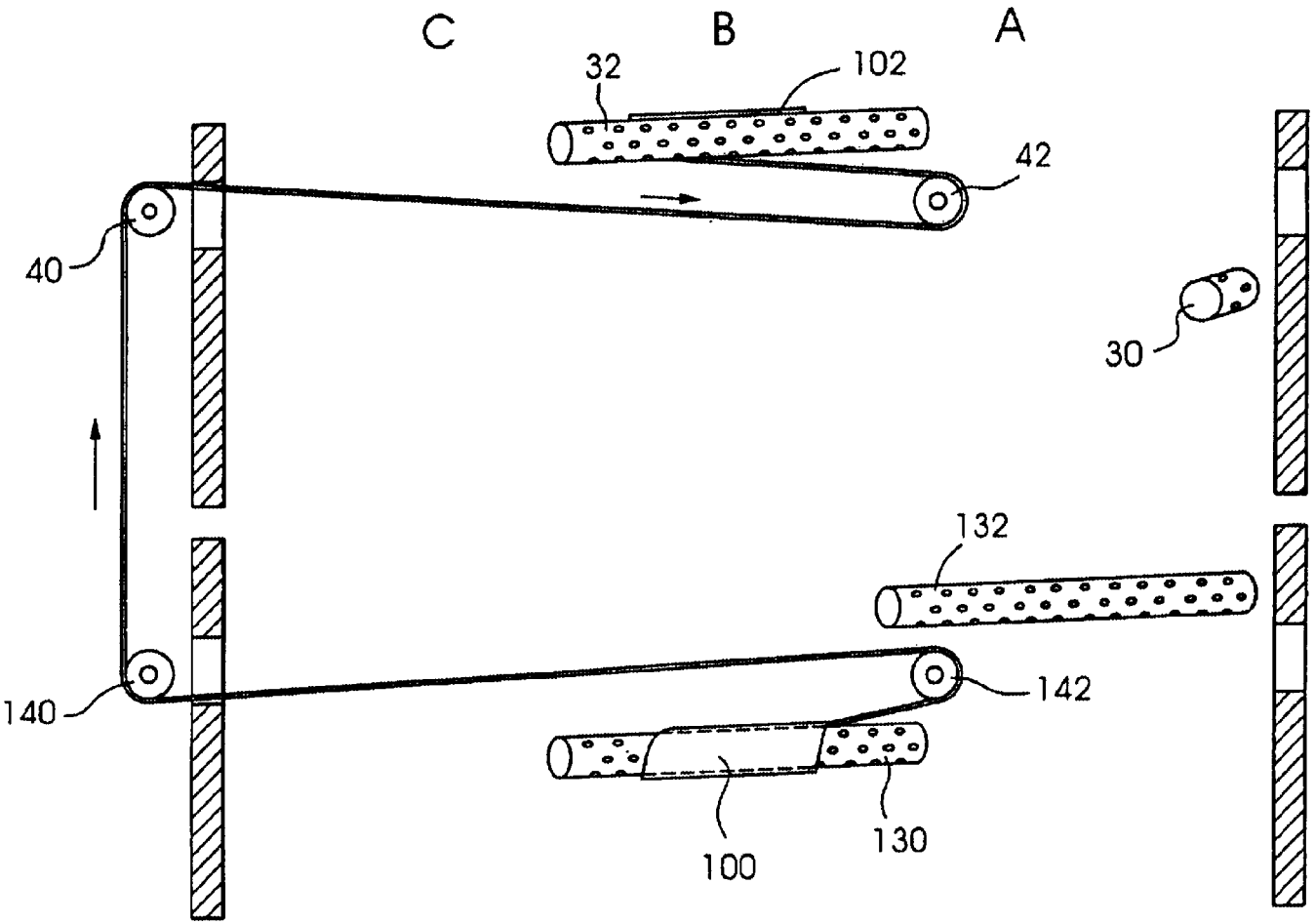
FIG. 7 shows the device according to the present invention with the web entering at lateral location B, passing up a left bay window, and exiting in a reverse orientation at location B.

FIG. 7 shows web 100 entering over angle bar 130 at lateral location B, passing over roller 142, passing up a left bay window over rollers 140 and 40, passing over roller 42 and exiting over angle bar 32 at position 102 in a reverse orientation at location B. Angle bar 130 is reversed 90 degrees from the orientation in FIG. 6.

Figure 8:
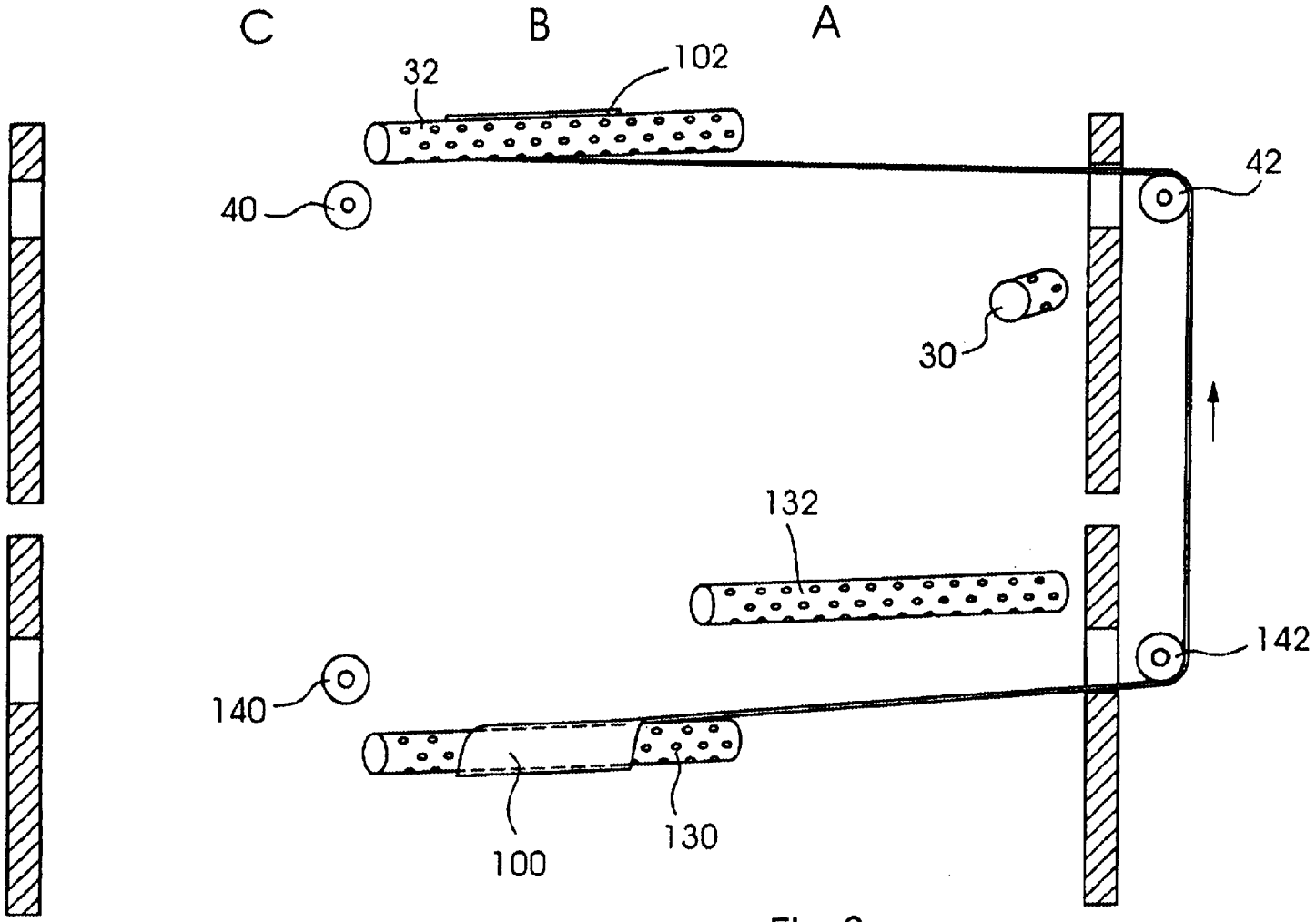
FIG. 8 shows the device according to the present invention with the web entering at lateral location B, passing up a right bay window, and exiting in a reverse orientation at location B.

FIG. 8 shows web 100 entering at lateral location B over angle bar 130, passing up a right bay window over rollers 142 and 42, and exiting in a reverse orientation over angle bar 32 at location B.

Figure 9:
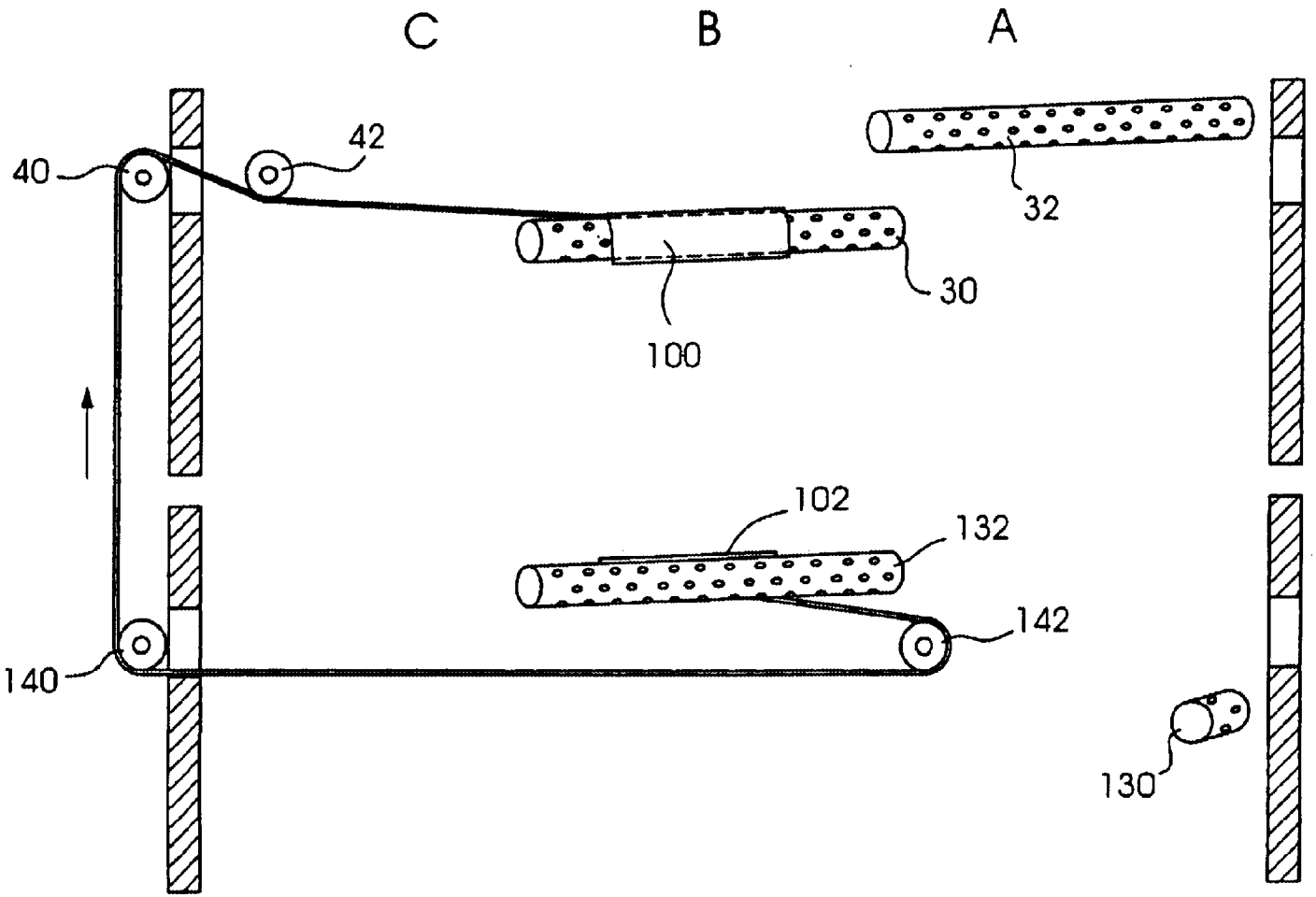
FIG. 9 shows the device according to the present invention with the web entering at lateral location B, passing down a left bay window, and exiting in a same orientation at location B.

FIG. 9 shows the device with web 100 entering at lateral location B over angle bar 30, passing past roller 42, down a left bay window with rollers 40, 140, over roller 142, and exiting over angle bar 132 in a same orientation at location B.

Figure 10:
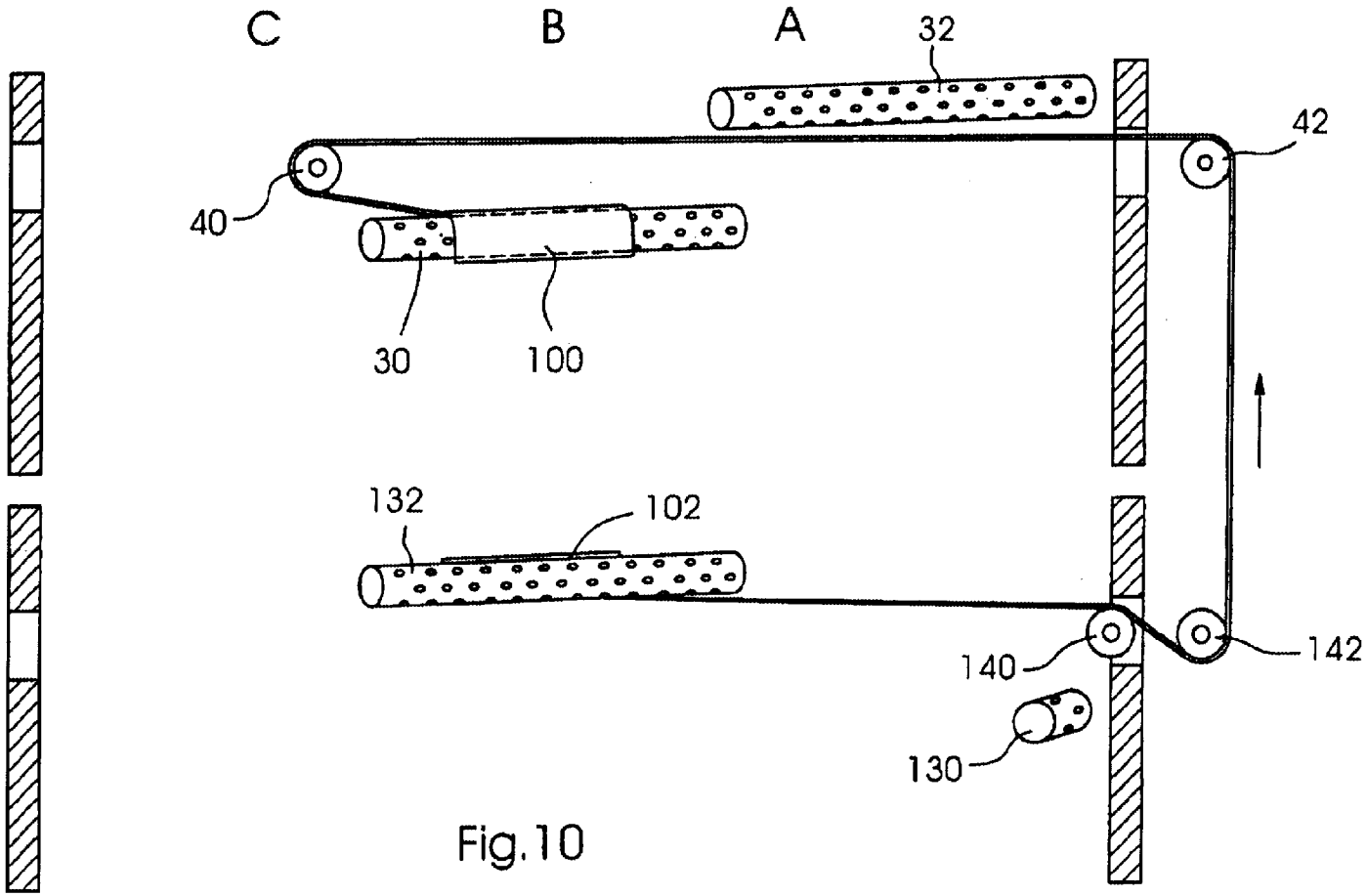
FIG. 10 shows the device according to the present invention with the web entering at lateral location B, passing down a right bay window, and exiting in a same orientation at location B.

FIG. 10 shows web 100 entering at lateral location B over angle bar 30, passing down a right bay window with rollers 42, 142, over roller 140 to angle bar 132, exiting in a same orientation at location B.

Figure 11:
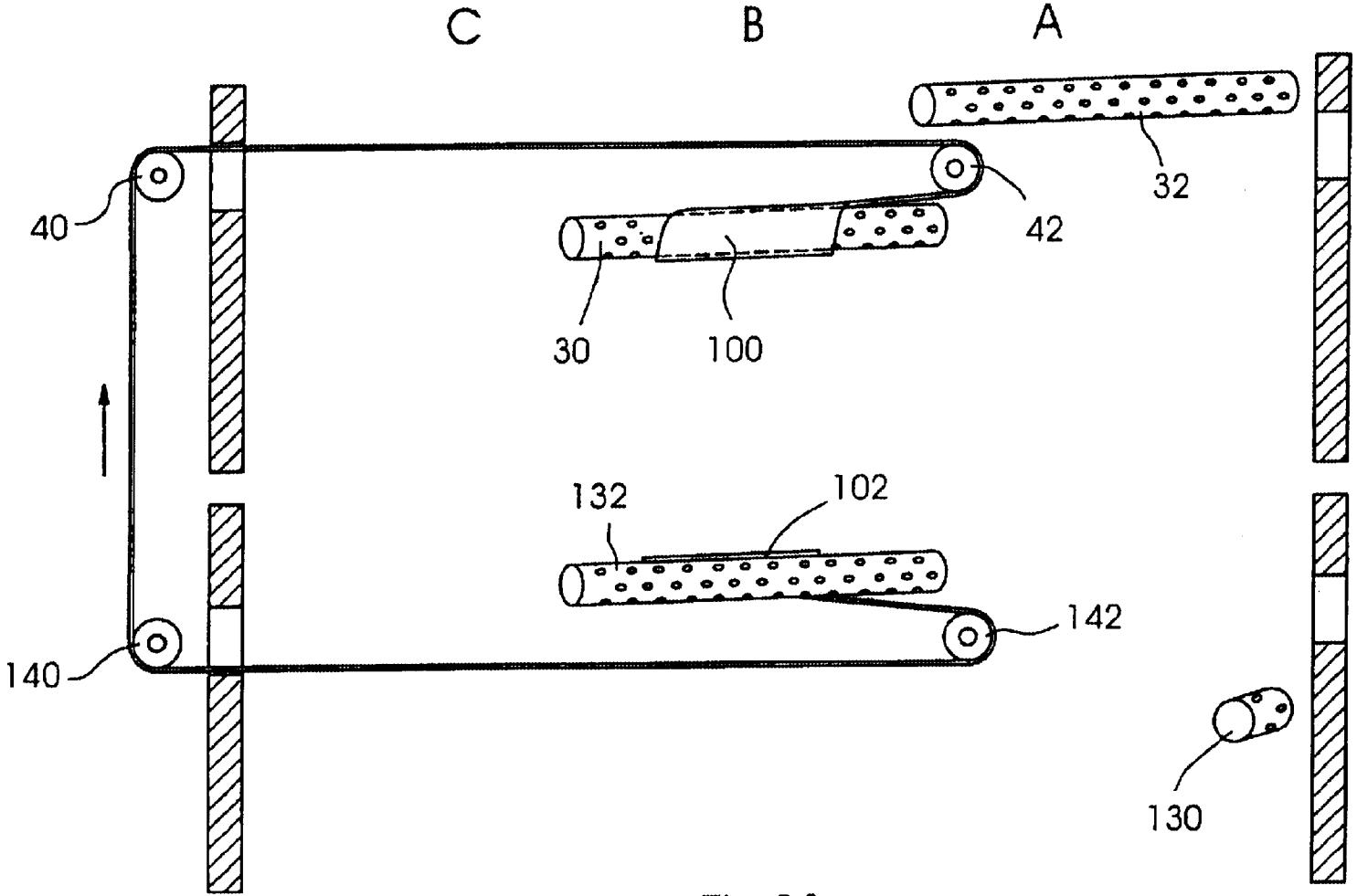
FIG. 11 shows the device according to the present invention with the web entering at lateral location B, passing down a left bay window, and exiting in a reverse orientation at location B.

FIG. 11 shows the device according to the present invention with web 100 entering over angle bar 30 (now in a 90 degree reversed orientation) at lateral location B, passing over roller 42 to roller 40 in a left bay window position, down a left bay window over roller 140, moving laterally to roller 142 and exiting over angle bar 132 in a reverse orientation at location B.

Figure 12:
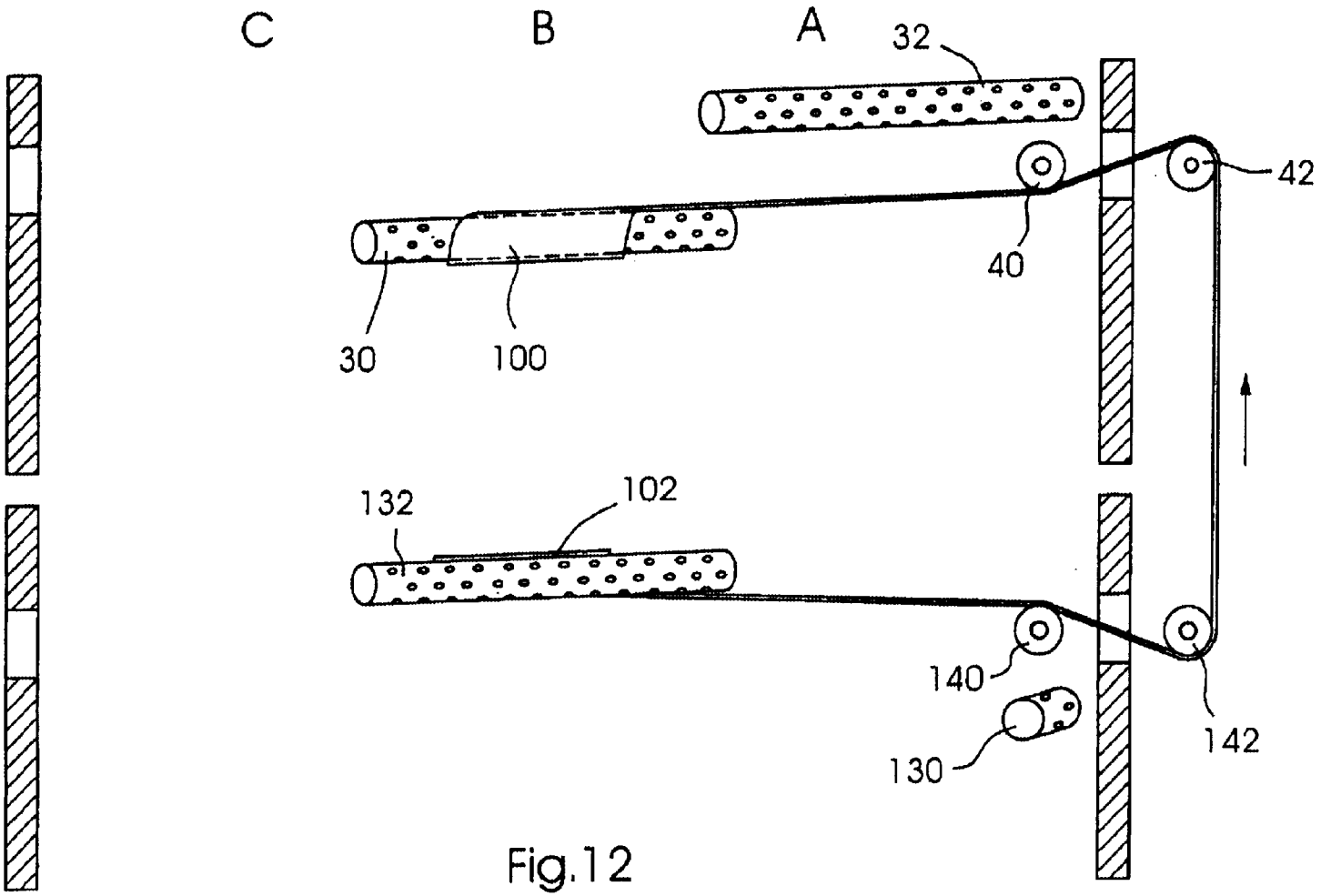
FIG. 12 shows the device according to the present invention with the web entering at lateral location B, passing down a right bay window, and exiting in a reverse orientation at location B.

FIG. 12 shows web 100 passing over angle bar 30 in its reversed position, passing past roller 40 down a right bay window with rollers 42, 142, past roller 140 and exiting over angle bar 132 in a reverse orientation.

While FIGS. 5 to 12 show lateral location B entrance and lateral location B exit, other lateral entrance and exiting positions are of course possible.

In the preferred embodiment, the tracks 50, 52, 54 define paths for movement by the respectively components.

What is claimed is:

1. A device for guiding a web having an entering web direction comprising:

a frame;

a first angle bar angled with respect to the entering web direction and supported by the frame for lateral movement along a first path, the first angle bar having a first lateral side and a second lateral side;

a second angle bar angled with respect to the entering web direction and supported by the frame for movement along a second path; and a roller for changing a direction of the web between the first angle bar and second angle bar, the roller being movable along a third path so as to be movable laterally beyond both the first lateral side and second lateral side of the first angle bar.

2. The device as recited in claim 1 wherein the first and second angle bars are parallel to each other in one operating position and at a 90 degree angle to each other in another operating position.

3. The device as recited in claim 1 further comprising a second roller movable along the third path.

4. The device as recited in claim 3 wherein the second roller can move laterally beyond both the first lateral side and second lateral side of the first angle bar.

5. The device as recited in claim 1 wherein the roller is movable laterally between the first and second lateral sides and beyond the frame in one direction.

6. A device for guiding a web having an entering web direction comprising:

a frame;

a first angle bar angled with respect to the entering web direction and supported by the frame for movement along a first path, the first angle bar having a first side and a lateral side;

a second angle bar angled with respect to the entering web direction and supported by the frame for movement along a second path; and a roller for changing a direction of the web between the first angle bar and second angle bar, the roller being movable along a third path so as to be movable laterally beyond both the first side and second side of the first angle bar;

wherein the first, second and third paths are all horizontal, the third path being located vertically between the first and second paths.

7. The device as recited in claim 1 further comprising additional angle bars located on a level beneath the first and second angle bars, and at least one additional roller between the additional angle bars.

8. The device as recited in claim 7 wherein the roller and the additional roller are movable laterally beyond the frame to create a bay window for the web.

9. The device as recited in claim 1 wherein the first and second angle bars each have at least two lateral operating positions.

10. The device as recited in claim 9 wherein the movable roller has at least two lateral operating positions.

11. The device as recited in claim 10 wherein the movable roller has at least four operating positions.

12. A device for guiding a web having an entering web direction comprising:

a first angle bar angled with respect to the entering web direction in a first orientation, the first angle bar having a second orientation ninety degrees from the first orientation and having at least two lateral operating positions along a first path;

a second angle bar angled with respect to the entering web direction and capable of being parallel or oriented ninety degrees from the first angle bar, and also having the at least two lateral operating positions; and a first roller for changing a direction of the web between the first angle bar and second angle bar, the first roller being positionable along a third path so as to receive the web from the first angle bar at one lateral side of the first angle bar in the first orientation and at the other lateral side of the angle bar in the second orientation.

13. The device as recited in claim 12 wherein the third path is horizontal.

14. The device as recited in claim 13 wherein the first angle bar has at least three lateral operating positions.

15. A device for guiding a web having an entering web direction comprising:

a first angle bar angled with respect to the entering web direction in a first orientation, the first angle bar having a second orientation ninety degrees from the first orientation, the first angle bar movable laterally along a first path;

a second angle bar angled with respect to the entering web direction and capable of being parallel or oriented ninety degrees from the first angle bar, the second angle bar movable laterally along a second path; and a first roller for changing a direction of the web between the first angle bar and second angle bar, the first roller capable of being positioned along a third path, the third path having at least the same lateral extent as the first and second paths.

16. The device as recited in claim 15 wherein the third path has a greater lateral extent than the first and second paths.

17. The device as recited in claim 15 wherein the third path is horizontal.

18. The device as recited in claim 15 wherein the first path and third path are parallel.

19. The device as recited in claim 1 wherein the first path and third path are parallel.

20. The device as recited in claim 12 wherein the first path and third path are parallel.

* * * * *